US006079656A

United States Patent [19]

Schmodde et al.

[11] Patent Number: 6,079,656

[45] Date of Patent: Jun. 27, 2000

[54] THREAD FEED DEVICE FOR ELASTIC YARN

[75] Inventors: Hermann Schmodde, Horb-Dettlingen; Gerhard Park, Freudenstadt, both of Germany

[73] Assignee: Memminger-IRO GmbH, Dornstetten, Germany

[21] Appl. No.: 09/051,157

[22] PCT Filed: Sep. 17, 1996

[86] PCT No.: PCT/DE96/01749

§ 371 Date: Apr. 2, 1998

§ 102(e) Date: Apr. 2, 1998

[87] PCT Pub. No.: WO97/13907

PCT Pub. Date: Apr. 17, 1997

[30] Foreign Application Priority Data

Oct. 6, 1995 [DE] Germany ..... 195 37 215

[51] Int. Cl.[7] ..... B65H 51/02

[52] U.S. Cl. ..... 242/365.7; 242/366; 242/366.4; 242/418; 276/44; 66/132 R

[58] Field of Search ..... 242/365.7, 366, 242/366.4, 418.1, 418; 226/44, 45; 66/132 R, 125 R, 132 T

[56] References Cited

U.S. PATENT DOCUMENTS

| | | | |
|---|---|---|---|
| 3,613,975 | 10/1971 | Knight | 276/25 |
| 3,746,226 | 7/1973 | Leclercq | 66/132 R X |
| 3,776,480 | 12/1973 | Lawson | 66/132 T X |
| 3,858,416 | 1/1975 | White et al. . | |
| 4,031,923 | 6/1977 | Van Duynhoven | 139/97 |
| 4,261,526 | 4/1981 | Roj | 66/132 R X |
| 4,353,227 | 10/1982 | Shields et al. . | |
| 4,523,440 | 6/1985 | Voisin et al. | 66/146 |
| 4,629,137 | 12/1986 | Schippers et al. | 66/132 R X |
| 4,660,783 | 4/1987 | Roser et al. | 242/366 X |
| 4,720,985 | 1/1988 | Goller et al. | 66/132 R X |
| 4,752,044 | 6/1988 | Memminger et al. . | |
| 4,843,879 | 7/1989 | Enderlin et al. | 73/160 |
| 5,176,334 | 1/1993 | Dreschau et al. | 226/44 X |
| 5,240,194 | 8/1993 | Noirot et al. | 242/418.1 |
| 5,590,547 | 1/1997 | Conzelmann | 66/132 R |
| 5,727,746 | 3/1998 | Fabschitz | 66/132 R X |
| 6,010,052 | 1/2000 | Leins et al. | 226/44 |

FOREIGN PATENT DOCUMENTS

| | | | |
|---|---|---|---|
| 2323241 | 11/1974 | Germany | 66/132 R |
| 3002311 | 7/1981 | Germany | 66/132 R |
| 36 27 731 C1 | 8/1987 | Germany . | |
| 38 20 618 C2 | 12/1989 | Germany . | |
| 40 32 402 A1 | 4/1992 | Germany . | |
| 4032402 | 4/1992 | Germany | 66/132 R |
| 42 06 607 A1 | 4/1993 | Germany . | |
| 3008842 | 1/1991 | Jordan | 66/146 |
| 482854 | 1/1970 | Switzerland | 66/132 R |
| 1053130 | 12/1966 | United Kingdom | 66/132 R |
| 8102901 | 8/1981 | WIPO | 66/132 R |
| WO 88 08883A | 11/1988 | WIPO . | |
| 9421849 | 9/1994 | WIPO | 66/125 R |

*Primary Examiner*—Donald P. Walsh
*Assistant Examiner*—Minh-Chau Pham
*Attorney, Agent, or Firm*—Frishauf, Holtz, Goodman, Langer & Chick, P.C.

[57] ABSTRACT

A yarn supply apparatus for elastic yarns in knitting machines having abruptly fluctuating yarn consumption. A yarn wheel, around which the yarn to be supplied is wrapped, furnishes the yarn to a yarn store located between a knitting station and the yarn wheel. A closed-loop controller responsive to yarn tension operates the yarn wheel via a low-inertia drive motor. The yarn store is embodied as an essentially straight segment of yarn in the yarn path in which yarn is guided so it can expand freely. The combination of a low-inertia drive motor, a yarn store that utilizes the intrinsic elasticity of the yarn, and a closed-loop controller that monitors the yarn tension by means of a sensor device makes it possible to use the yarn supply apparatus for supplying elastic yarns and to keep the yarn tension essentially constant even when the demand for yarn fluctuates abruptly.

30 Claims, 4 Drawing Sheets

THREAD FEED DEVICE FOR ELASTIC YARN

FIELD OF THE INVENTION

The invention relates to yarn supply apparatus, and more particularly to a yarn supply apparatus which serves to supply elastic yarns, ribbons, strands and the like when demand fluctuates abruptly over time.

BACKGROUND INFORMATION

In knitting machines, yarn supply apparatuses have the task of supplying the appropriate knitting stations with yarn at the correct time, at the requisite tension, and in the desired amount. This is especially true for elastomeric yarns or other kinds of elastic yarns, which are predominantly processed in combination with hard or in other words essentially inelastic yarns (basic yarns) to make more or less elastic knitted goods. The tension of the elastomeric yarn substantially determines the feel and dimensional rigidity of the resultant knitted goods. Fluctuations in the tension of the elastomeric yarn supplied, especially when they recur systematically from one row of loops to another, can lead to a substantial impairment in quality of the knitted goods produced.

Because of the high expansion of often-used elastomeric yarns, which is up to 600% of the basic length, keeping the yarn tension constant requires an appropriate yarn supply apparatus, which furnishes the correct yarn quantity at a given time regardless of the yarn consumption at the time and regardless of the initial tension of the yarn paid out from a yarn bobbin.

This is true especially for knitting machines with an abruptly changing and at least sometimes very high yarn consumption, such as flatbed knitting machines or other knitting machines, in which a single yarn supply apparatus by itself supplies one row of needles. In flatbed knitting machines, the loop-forming needles arranged in one or more rows are supplied with one or more yarns to be knitted by means of a yarn guide moving back and forth in translational motion along the row of needles. Yarn supply is effected by means of a yarn supply apparatus which is located laterally next to the yarn guide in such a way that the yarn guide in its operating motion moves toward and away from the yarn supply apparatus. It will be appreciated that the requisite yarn supply quantity varies considerably in the two phases of operation. A further factor is that at the turning points between the two operating phases, zero yarn consumption occurs, and at the transition from the operating phase moving away from the yarn supply apparatus to the operating phase moving toward it, a brief interval of operation occurs in which the yarn travels backward.

For applications with yarn consumption that fluctuates greatly over time, the yarn supply apparatus known from German Patent DE 36 27 731 C1 was developed; it has a yarn wheel driven by a stepping motor. The yarn wheel carries the yarn, drawn from a yarn bobbin, to the applicable knitting station via a yarn brake.

The yarn supplied by the yarn wheel travels through a terminal eyelet of a lever supported pivotably on its other end; the eyelet represents a turning point, at which the yarn is rerouted at an acute angle. To adjust a constant yarn tension, the pivot lever is acted upon by a constant torque by means of a direct current motor. The pivot lever is also connected to a position transducer, which detects its pivoted position and readjusts the stepping motor accordingly. The pivot lever thus acts as a yarn store, for temporary storage of yarn that has not been drawn off by the knitting stations, yet has continued to be supplied because of the moment of inertia and the control characteristics of the stepping motor. It also serves to adjust the yarn tension and, in cooperation with the sensor device, to detect the existing yarn supply.

This yarn supply apparatus is only limitedly suitable for supplying elastic yarns, and the pivot lever proves to be overly insensitive for tension monitoring. Because of the intrinsic elasticity of the yarn, the pivot lever during operation reaches its extreme positions (stops), where the yarn tension is then not under control.

As a further development, the yarn supply apparatus for kinky and other effect yarns, known from German Patent DE 38 20 618 C2 is known; it has two rotationally driven yarn wheels, rotating in opposite directions, around which the yarn to be supplied is wrapped multiple times in a figure eight. An arm carrying an eyelet on its end and acted upon by torque in a predetermined direction of rotation acts as a yarn store for temporarily storing yarn intermittently not drawn off by the knitting stations. The yarn travels at an acute angle through its terminal eyelet, and for temporary storage it is deposited on bolts or posts located along a circle around the arm.

Frictional effects that affect yarn travel occur both on the bolts or posts forming a temporary store and at the eyelet of the arm through which the yarn travels at an acute angle.

From German Patent Disclosure DE 42 06 607 A1, a yarn supply apparatus for simultaneously supplying two yarns to a knitting machine is known, in which a yarn supply wheel is driven by a disk rotor motor. At least one yarn travels from the yarn supply wheel through the longitudinal opening of a helical spring wound in a conical or trumpet shape. A permanent magnet and a Hall sensor are provided on a bearing that pivotably holds the helical spring on one end, to enable detecting deflections of the helical spring. On the basis of these deflections, the disk rotor motor is readjusted, so that the command length of the helical spring is established in steady-state operation. In that position, the yarn travels laterally along the inner wall of the helical spring, through the opening in it. The helical spring acts as a spring and damping element, which allows a certain temporary storage of supplied yarn.

Finally, U.S. Pat. No. 3,858,416 discloses a yarn supply apparatus which is suitable for knitting machines that have substantially constant yarn consumption and for supplying hard yarns. The yarn supply apparatus has an electric motor whose rpm is controllable via the applied voltage and which by means of a suitable yarn wheel draws yarn from a bobbin and delivers it to the appropriate knitting station via a yarn tension sensor. A command value transducer is also present, which is connected to a command value input of a closed-loop controller, via a reversing switch and via selectively actuatable adjusting devices. Via the reversing switch, the controller receives a signal, characterizing the yarn tension, at its actual value input, and it readjusts the motor accordingly. Rpm sensors are also present on the electric motor and on the knitting machine; given a suitably different switch position of the reversing switch, they can be connected to the command value and actual value inputs of the controller. The reversing switch allows a switchover from one operating mode, with a yarn tension regulated so that it is constant, to an operating mode with a defined yarn supply quantity. Each knitting station of the circular knitting machine is assigned a corresponding yarn supply apparatus; so that the quantity of yarn to be supplied corresponds to the yarn consumption of a knitting station. The yarn travel speed is correspondingly low.

There are no provisions made for temporarily storing any possible excess lengths of yarn supplied as a result of motor inertia or motor characteristics or suddenly required to be paid out.

Such a yarn supply apparatus is not suitable for supplying elastic yarns to knitting machines that have a high yarn travel speed and abrupt changes in speed, of the kind that occur in flat bed knitting machines.

OBJECTS AND SUMMARY OF THE INVENTION

It is an object of the invention to create a yarn supply apparatus by means of which knitting machines can be supplied with elastic yarns at high speeds, which speeds can abruptly change, at an essentially constant yarn tension.

This object is attained with a yarn supply apparatus as defined by the claims.

The yarn supply apparatus is a feed wheel mechanism for yarns, ribbons and the like, which thanks to the low moments of inertia of the drive device and yarn wheel can be adapted intrinsically to rapidly changing yarn payout conditions. In supply phases, at full yarn consumption, yarn speeds of up to several meters per second (6 m/sec) are attained. Between supply phases, abruptly occurring phases of stoppage and/or reverse travel occur. The yarn store provided makes it possible for the quantities of yarn occurring at the transition between these phases to be taken up again or paid out again, without substantially changing the yarn tension. A substantially travel-free sensor device is used as a tension sensor for monitoring the yarn tension. The measurement stroke of the sensor device, with vanishing in comparison to the quantity of yarn to be temporarily stored, makes it possible to adjust the yarn tension practically independently of forces of acceleration of any moving parts of the sensor device. Thus the sensor device has low mass, is highly dynamic, and is feedback-free. The yarn store and the sensor device are operationally separated from one another. In a concrete case, this is accomplished in that the measurement travel of the sensor device, which is kept short, is substantially at a right angle to the travel direction of the yarn.

Another aspect of our invention is that the entire yarn path traversed by the yarn is embodied as nonresilient; that is, all the yarn guide elements are rigidly mounted. It is thus possible to successfully preclude oscillation of machine elements that could affect the yarn tension. The only yielding or resilience in the system is produced by the intrinsic elasticity of the yarn itself, and as a result a yarn store is formed in a travel segment dimensioned specifically for this.

Because the yarn store is formed as a travel segment between the yarn supply wheel and the knitting station, in which the elastic yarn is guided so that can expand freely, a yarn store is created that receives the yarn segment to be stored without friction. This is successfully attained because the travel segment acting as a yarn store is dimensioned as long enough that the spring constant resulting from the corresponding yarn undershoots a limit value. This limit value is the quotient of the maximum change in force and the maximum yarn length to be received by the yarn store. The length of the travel segment formed by the yarn store is preferably more than one-half meter. When the yarn supply apparatus is located laterally, or in other words essentially in the extension of a row defined by the loop-forming needles, the travel segment acting as a yarn store between the yarn supply wheel and the yarn guide of the knitting machine periodically changes its length with the operating cycles of the knitting machine. Thus the yarn store changes its holding capacity. In the sense that the greatest yarn delay occurs at the end of the phase in which the yarn guide moves away from the yarn supply apparatus, this provision appropriately takes into account the conditions that occur in flat bed knitting machines at the end of the moving-away phase. In the moving-away phase, a quantity of yarn that practically corresponds to twice the yarn consumption is fed. If the yarn guide arrives at its turning point and initially comes to rest there, the yarn consumption suddenly drops to zero. The resupply of elastic yarn caused by the continued operation of the drive device can be easily held by the yarn store, which has its greatest length, without persistently changing the yarn tension.

In contrast to this, at the opposite turning point, only a relatively slight change in speed of the yarn feeding is obtained, which is readily absorbed by the yarn store, which is shorter in this position.

The length of the yarn store of the yarn supply apparatus, which depends on the current position of the yarn guide, thus enables good adaptation of the holding capacity of the yarn store to the incident deviations in yarn feeding from the actual yarn consumption, especially in the tapering-off phases.

It has proved to be advantageous merely to slightly deflect the elastic yarn in order to measure its tension at the sensor device. This produces an obtuse yarn guide angle, which is preferably greater than 165°. Although the forces to be measured thereby are very slight, nevertheless the incident friction also becomes so slight that its influence becomes insignificant. This is especially important in elastomeric yarns.

The precision of the yarn supply apparatus is also aided if the sensor device (tension sensor) has a negligible maximum stroke, which is less by at least one order of magnitude than the length of the yarn segment to be temporarily stored. It is thus attained that the yarn segment is received only by the yarn store, and not by the sensor device. This is the case for instance if the element in contact with the elastic yarn has a maximum stroke that is shorter than 2 mm.

An element that produces a large signal at slight deflection is preferably used as the sensor for the shifting of the element in contact with the yarn. An example is strain gauges, piezoelectric sensors, and the like.

The sensor device may be structurally separate from the yarn supply apparatus. It becomes possible as a result to locate the sensor device as close as possible to the knitting stations or to the yarn guide. Changes in tension that occur at the knitting stations are thus detected quickly and are rapidly compensated for. The precision of control is also aided if the sensor device has a separate suspension that is decoupled in terms of oscillation from the knitting machine.

It is also advantageous if the yarn supply apparatus is likewise embodied such that it is separate from the knitting machine and/or is decoupled from it in terms of oscillation.

The drive device is controlled as a function of the yarn tension via a closed-loop controller. Incorrect operation is avoided if the controller, in all operating modes, functions independently of the running speed of the knitting machine. As a result, it can be attained that once the yarn tension has been set, it remains constant even if the machine running speed, the yarn guide stroke, the knitting pattern or other factors change. Misadjustments that could otherwise occur when the aforementioned parameters or the yarn type change are prevented. The controller may be a PI or a PID controller.

The yarn store, which is suitably large in size and in particular has its holding capacity adapted to the particular position of the yarn guide, makes it possible to use a stepping motor as a drive device for the yarn supply wheel. This stepping motor, preferably embodied as a disk rotor motor, has high dynamics, yet predetermined maximum values cannot be exceeded during acceleration and deceleration. The corresponding oversupply or undersupply of yarn is compensated for by the yarn store.

A reverse feeding of yarn at the turning point of the yarn guide, from its phase in which it moves away from the yarn supply wheel to its return phase, can be compensated for if the controller (trigger circuit) and the drive device are designed such that the yarn wheel can move in both rotational directions.

Moreover, it has proved to be advantageous to guide the elastic yarn with as little deflection as possible, so that it is given a uniform tension over its length.

Alternatively, the determination of the yarn tension can be done with two or more sensor devices, which are located at different points along the yarn travel. An actual signal for the controller is formed from the signal that is output by the sensor devices.

At least one filter, which keeps low frequencies or band-pass disturbance frequencies away from the controller may be located between the sensor device and the controller. Alternatively, band rejection filters or the like may be used. Compensation means for suppressing disturbance signals may be provided directly on the sensor device, for instance. Such compensating means are for instance formed by an identical measuring system that is not affected by the yarn. Given suitable adaptation and high self-damping, the difference between the signals output by the two sensor devices represents the yarn tension.

BRIEF DESCRIPTION OF THE DRAWINGS

One exemplary embodiment of the invention is shown in the drawings. Shown are.

DETAILED DESCRIPTION

Figure 1:
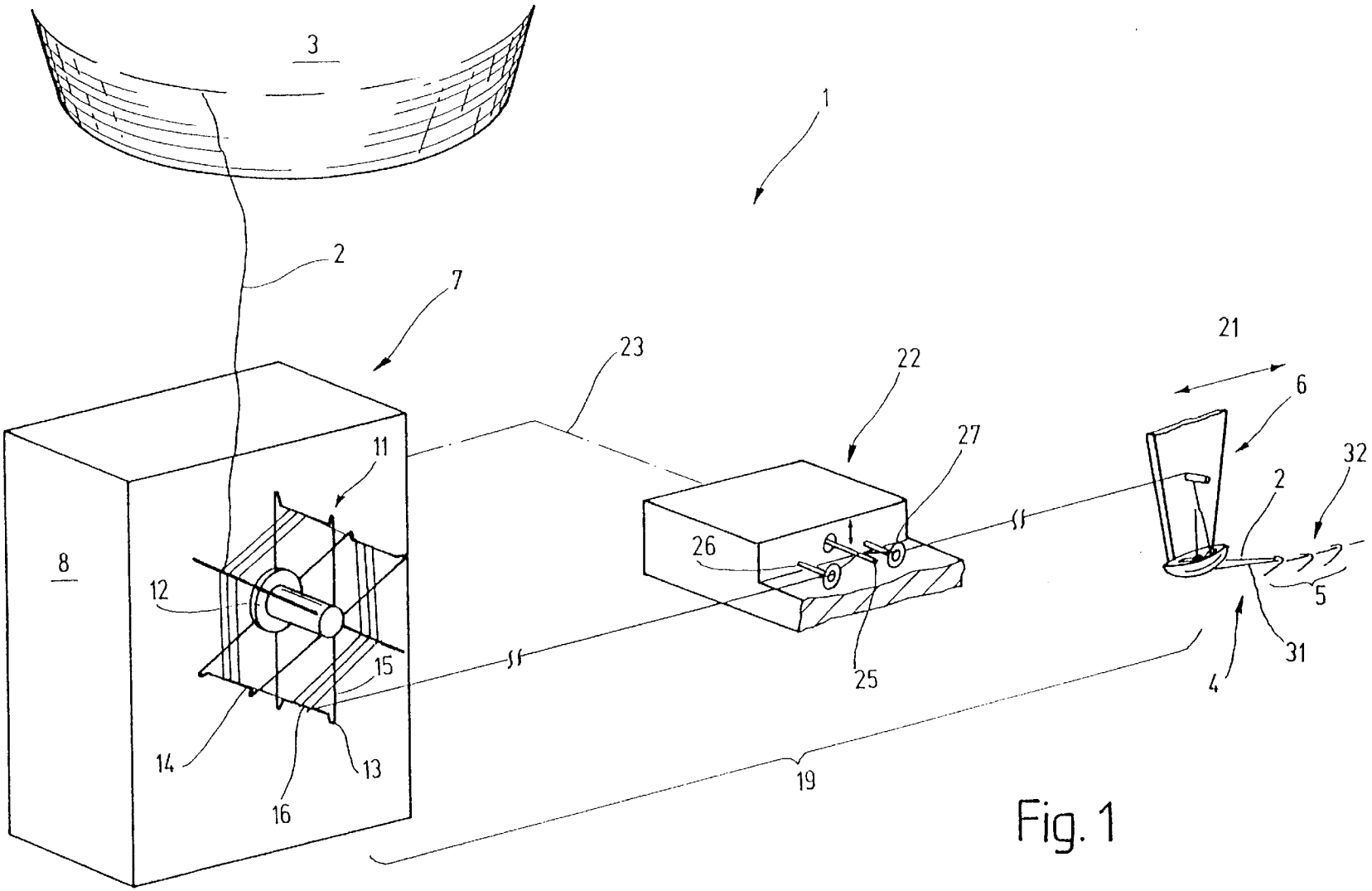
FIG. 1, a yarn supply apparatus in a flatbed knitting machine, in a schematic basic illustration.

FIG. 1 shows a yarn supply apparatus that delivers an elastic yarn 2 (elastomeric yarn) from a yarn bobbin 3 to a flatbed knitting machine 4, which is shown merely symbolically and in fragmentary fashion in the form of a few loop-forming needles 5 and a yarn guide 6. The yarn supply apparatus 1 includes a yarn feeder 7, which takes care of the drawing off of the yarn 2 from the yarn bobbin 3 and feeding it to the yarn guide 6.

Figure 2:
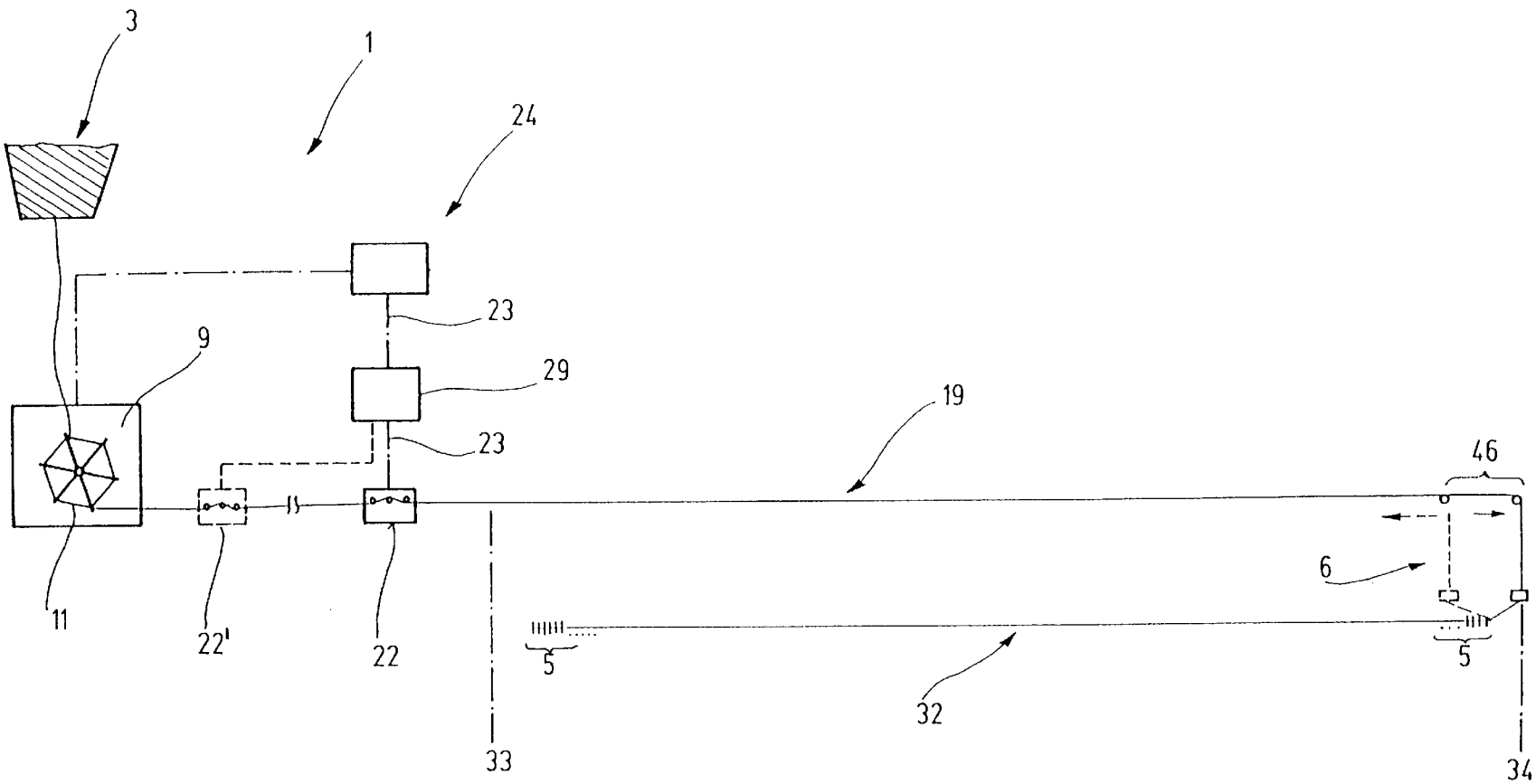
FIG. 2, a simplified view of the yarn supply apparatus of FIG. 1, in different operating phases and in a basic illustration.

The yarn feeder 7 has a housing 8, in whose interior there is a stepping motor 9, not shown in detail and schematically indicated in FIG. 2. The stepping motor 9 is embodied as a disk rotor and can thus be accelerated and braked within short time periods.

A yarn wheel 11 is seated on the drive shaft of the stepping motor 9 that protrudes out of the housing 8, being joined to the stepping motor in a manner fixed against relative rotation. The yarn wheel has a hub 12, from which a total of six wire hoops 13 extend radially away, spaced uniformly apart from one another. The wire hoops 13 each have two radially oriented spokes 14, 15, and one support segment 16 connecting the spokes. The support segments 16 receive the yarn 2, which wraps around the yarn wheel 11 a few times.

From the yarn wheel 11 to the yarn guide 6, a yarn store 19 is formed, through which the yarn 2 travels along over a substantially straight path. This path is oriented essentially parallel to a translational direction of the yarn guide 6, marked by an arrow 21 in FIG. 1.

Inside the yarn store 19 is a sensor device 22 for the tension of the yarn 2 traveling through it; it is connected by an output line 23 to a merely schematically shown closed-loop controller 24 (FIG. 2). The sensor device outputs an electrical signal that characterizes the yarn tension.

The sensor device 22, which has an element 25 that is supported so as to be movable with a very short stroke, is embodied as a substantially travel-free tension sensor. It deflects the yarn 2 vertically, and the yarn travels to both sides of the element 25 via two back stops 26, 27, preferably embodied as eyelets. With the line connecting them, the back stops 26, 27 define the travel direction of the yarn 2, which is orthogonal to the deflection direction of the element 25. The lateral deflection of the yarn 2 at the sensor device 22 is so slight that the obtuse angle through which the yarn 2 travels, whose apex is at the element 25, is greater than 165°.

The sensor device 22 includes a strain gauge, which converts the variable deflection of the element 25, caused by fluctuations in yarn tension, into electrical signals that are supplied to the controller 24. The movement of the element 25 is so slight that it does not cause any measurable change in the tension of the yarn 2.

As can be seen from FIG. 2, a filter 29 that filters out disturbance frequencies is optionally located between the sensor device 22 and the controller 24. These frequencies may be due to vibration of the sensor device 22 or to scattering. Moreover, both the yarn feeder 7 and the sensor device 22 are suspended in a low-vibration manner.

As can be seen from FIGS. 1 and 2 in conjunction with the above description, the total yarn travel is kept as free of deflection as possible. From the yarn bobbin 3, the yarn 2 travels without deflection and unbraked, that is, without a yarn brake, to the yarn wheel 11; from there, it travels without significant deflection to the yarn guide 6. The yarn guide carries the elastic yarn 2 to the needles 5 in such a way that in each direction of motion it trails after a hard basic yarn 31.

The yarn supply apparatus 1 described thus far functions as follows:

In FIG. 2, the flatbed knitting machine suggested as an example is represented by a row 32 of loop-forming needles 5. During knitting, the needles 5 are projected and retracted again in the manner of one continuous shaft, while the yarn guide 6 is moved translationally back and forth in the direction of the arrow 21. In the process, the yarn guide 6 moves from a nearby terminal position 33 to a far terminal position 34, for instance, and the yarn supply apparatus 1 must resupply a quantity of yarn that is greater than twice the distance traveled by the yarn guide 6.

Figure 3:
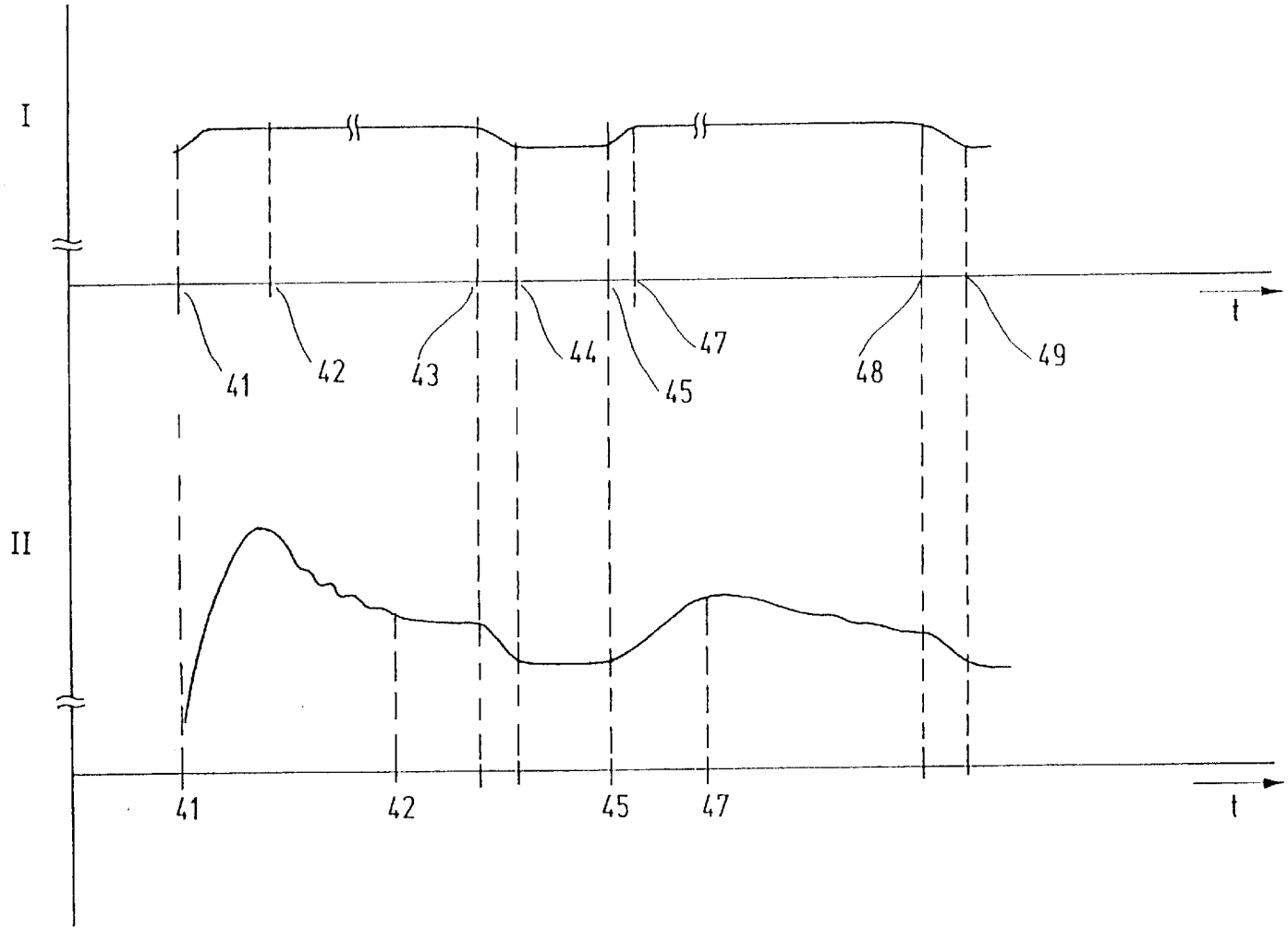
FIG. 3, the course over time of the yarn tension in the yarn supply apparatus of FIGS. 1 and 2, in comparison to a yarn supply apparatus known from the prior art.

The yarn tensions that occur in a knitting operation are shown in FIG. 3. The start of the motion of the yarn guide 6 out of the nearby terminal position 33 is indicated at 41 in the upper graph 1 of FIG. 3. During starting, the tension of the yarn 2 is initially still within a tolerance range, which is detected by the sensor device 22. Initially, the stepping motor 9 and the yarn wheel 11 are still at rest. The yarn consumption that ensues abruptly, however, is initially covered by the yarn store, and the yarn tension initially increases somewhat. The rising yarn tension causes the controller 24 to accelerate the stepping motor 9. The yarn wheel 11 draws the yarn 2 from the yarn bobbin 3 and feeds it into the yarn store 19, whose length increases because the yarn guide 6 is moving away.

After a certain rise time, which is ended at 42, the yarn wheel 11 furnishes precisely the yarn quantity consumed by the flat bed knitting machine 4 and received by the yarn store 19.

Once the yarn guide 6 has arrived at the far terminal position 34, it stops immediately. This moment is indicated at 43 in the graph I of FIG. 3. During a period of time lasting until 44, the controller 24 brings the stepping motor 9 and thus the yarn wheel 11 to a stop; the yarn tension drops slightly, or in other words within the tolerance range. If the tolerance range is made quite narrow, then the requisite yarn tension is built up again by reversal of the yarn wheel 11 while the yarn guide 6 is stopped in its far terminal position 34. Because the elastic yarn 2 is guided without a yarn brake between the yarn bobbin 3 and the yarn wheel 11, reverse feeding is possible without risking disruption of the yarn travel.

In the return stroke of the yarn guide 6, started at 45 in FIG. 3, the yarn guide 6 initially travels through an idle phase, designated by numeral 46 in FIG. 2, within which yarn consumption does not yet occur at the knitting stations, yet yarn 2 is released by the incipient reverse travel of the yarn guide 6. This yarn is received by the yarn store 19 and is compensated for as needed by briefly reversing the feeding of the yarn wheel 11. The yarn consumption that then ensues, in the motion toward the nearby terminal position 33, is markedly less than in the opposite motion toward the far terminal position 34. The yarn supply apparatus 1 therefore easily furnishes the required yarn quantity to the yarn store 19, which is becoming shorter.

Beginning a time 47 at which the yarn tension has reached its upper limit value, this tension is kept constant over the entire return path of the yarn guide 6, until the yarn guide, at 48, has reached its nearby terminal position 33. Slight lagging on the part of the yarn wheel 11 can lead to a slight reduction in the yarn tension, up to a time 49.

In FIG. 3, the course of yarn tension attainable with the yarn supply apparatus 1 (graph I) is compared with a yarn tension course (graph II) of the kind attained with the yarn supply apparatus known from the prior art in accordance with German Patent DE 36 27 731 C1. As noted in the background section, this yarn supply apparatus has a yarn-deflecting pivot lever as its yarn store. The dimensions and friction thereof affect the yarn tension and the controller. As graph II shows, for identical times 41–49, the transient phase for the yarn tension on the return leg (41–42) is lengthened considerably, and tension peaks occur that can cause tearing of the yarn. Even in the return course of the yarn, a transient event occurs between times 45 and 47 and leads to an excessive increase in yarn tension that causes an uneven knitted product to be created.

The deviations in tension on the right and left edges of the knitted goods are especially quite variable, which is deleterious to the outcome of knitting. By comparison, in the yarn supply apparatus 1 of the invention, as shown in graph I, the yarn tension is substantially constant; particularly on both edges of the knitted goods (nearby and far terminal positions 33, 34), identical or nearly identical yarn tensions prevail.

As shown in dashed lines in FIG. 2, in addition to the single sensor device 22, a further sensor device 22' that scans the yarn tension can be provided. It detects the yarn tension at a different point along the yarn travel path. The controller forms the average of the signals of the two sensor devices 22, 22', for instance, and uses this average as an actual value for the yarn tension. This makes it possible to minimize the effectiveness of disturbance variables.

Figure 4:
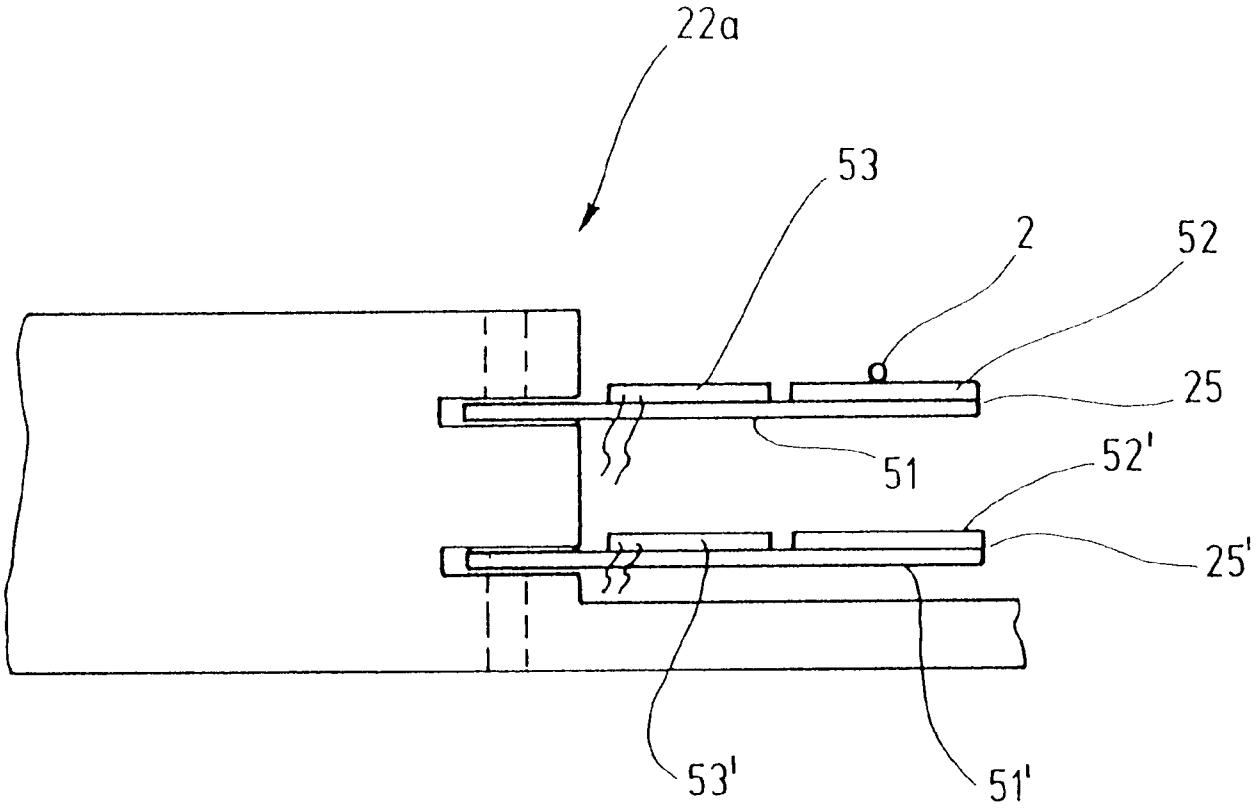
FIG. 4, an embodiment of a sensor device for determining the yarn tension, in a schematic cross-sectional view.

A modified embodiment of a sensor device **22*a* is shown in FIG. 4. The sensor device 22*a* has a first element 25, which contains a spring tongue 51 and which guides the yarn 2 by means of a ceramic yarn support surface 52. A strain gauge 53 converts the flexion of the spring tongue 51 into an electrical signal. A structurally identical element 25' likewise has a ceramic yarn support surface 52' and a strain gauge 53'. The two elements 25, 25' are supercritically damped, and thus do not vibrate in response to sudden excitation. The element 25' is not in contact with the yarn 2. The sensor output signal is the difference between the two signals output by the strain gauges 53, 53'**. In this way, disturbance variables from impact and/or vibration are minimized.

A yarn supply apparatus 1 for elastic yarns in knitting machines with chronologically very severely fluctuating and periodically high yarn consumption has been created that is embodied as a feed wheel mechanism. The yarn supply apparatus 1 has a yarn wheel 11, around which the yarn 2 to be supplied is wrapped a few times, and which furnishes the yarn 2 to a yarn store 19 located between the knitting machine and the yarn wheel 11. The yarn store 19 is embodied as an essentially rectilinear segment of the yarn path. To monitor the yarn tension, a sensor device 22 is provided whose measurement path is vanishingly short in comparison with the length of yarn to be stored in the yarn store 19. The measurement path is defined by a movable element 25 of the sensor device 22 and is oriented orthogonally to the travel path. It is short, less than 2 mm.

The combination of a low-inertia drive device 9, which has a yarn store 19 that utilizes the intrinsic elasticity of the yarn, and a controller 24 that monitors the yarn tension by means of a sensor device 22 makes it possible to use the yarn supply apparatus 1 for supplying elastic yarns and to keep the yarn tension essentially constant even when the demand for yarn fluctuates severely over time. Now that the yarn 2 in the yarn store 19 is not subject to deflection and in particular is not subject to significant friction, and now that the yarn 2 reaches the yarn wheel 11 without the interposition of a yarn brake, even short returns of yarn 2 from the knitting machine to the yarn supply apparatus 1 can be intercepted by briefly rotating the yarn wheel 11 in reverse.

What is claimed is:

1. A yarn supply apparatus for supplying yarn from a yarn source to knitting stations of a knitting machine having a yarn consumption which fluctuates abruptly over time, the yarn supply apparatus comprising:

means for defining a yarn travel path including:

(a) a yarn wheel (11) around which the yarn is wrapped a number of times;

(b) yarn guide means (6) receiving yarn from said yarn wheel for supplying yarn to a knitting station;

(c) an electric drive device (9), having a low moment of inertia, drivingly coupled to turn said yarn wheel for supplying the yarn;

(d) a sensor device (22) for detecting a tension of the yarn and providing an output signal related thereto;

a closed-loop controller (24) coupled to and controlling said drive device in response to the output signal from said sensor device such that the yarn tension is regulated to a preset value; and a yarn store (19) for (i) temporarily storing yarn that has been supplied by said yarn wheel and not used at the knitting station, (ii) providing the yarn that is needed at the knitting station upon abrupt fluctuation in the yarn tension but which has not yet been supplied by said yarn wheel, and (iii) re-receiving the yarn that has been supplied by said yarn wheel and not used at the knitting station;

wherein said yarn store is between said yarn wheel and the knitting station such that the yarn (2) is guided so that it can expand freely; and wherein the yarn store is long enough that the yarn segment located in the store defines a spring constant which is below a predetermined limit value that is the quotient of the maximum change in force and the maximum yarn length that can be received by the yarn store.

2. The yarn supply apparatus of claim 1, wherein the sensor device (22) enables the yarn (2) to be guided by the sensor device (22) at an obtuse angle at all yarn tensions.

3. The yarn supply apparatus of claim 1, wherein the sensor device (22) has an element (25) that is in contact with the yarn (2) and that has a maximum stroke which is short by at least one order of magnitude than the length of the yarn (2) that is to be temporarily stored and taken up by the yarn store (19).

4. The yarn supply apparatus of claim 1, wherein the sensor device (22) has a flexing element (51), whose flexion is determined by the yarn tension and which is coupled to a converter for determining the flexion.

5. The yarn supply apparatus of claim 4, wherein the converter is a mechanical-electrical converter with only slight required deflection.

6. The yarn supply apparatus of claim 1, wherein the sensor device (22) is structurally separate from the remainder of the yarn supply apparatus (1).

7. The yarn supply apparatus of claim 1, wherein the sensor device (22) has a separate suspension, which is oscillationally decoupled from the knitting machine (4).

8. The yarn supply apparatus of claim 1, wherein the apparatus is oscillationally decoupled from the knitting machine (4).

9. The yarn supply apparatus of claim 1, further comprising a closed-loop controller (24), which in all operating modes, regardless of the running speed of the knitting machine (4), triggers the drive device (9) on the basis of the yarn tension determined by the sensor device (22).

10. The yarn supply apparatus of claim 9, further comprising a filter (29) disposed between the sensor device (22) and the controller (24) and connected to the sensor device.

11. The yarn supply apparatus of claim 10, wherein the filter (29) blocks out disturbance frequency ranges.

12. The yarn supply apparatus of claim 1, wherein the closed-loop controller (24) is a PI controller.

13. The yarn supply apparatus of claim 1, wherein the closed-loop controller is a PID controller.

14. The yarn supply apparatus of claim 1, wherein the drive device (9) is a stepping motor.

15. The yarn supply apparatus of claim 1, wherein the drive device (9) is a disk rotor motor.

16. The yarn supply apparatus of claim 1, wherein the drive device (9) and a corresponding trigger circuit (controller 24) are designed such that the drive device (9) can be operated in two rotational directions.

17. The yarn supply apparatus of claim 1, wherein the yarn wheel (11) is formed by wire hoops (13) extending radially and secured to a hub (12), which wire hoops each have a segment (16) extending essentially rectilinearly in the axial direction for supporting the yarn, and each wire hoop (13) has two spoke segments (14, 16), which support the axial segment (16).

18. The yarn supply apparatus of claim 1, wherein the yarn travel of the yarn wheel (11) is guided essentially without deflection up to a machine element (6) of the knitting machine (4) that guides the yarn (2).

19. The yarn supply apparatus of claim 1, further comprising two independently operating sensor devices (22, 22'), which are spaced apart from one another in the yarn travel path.

20. The yarn supply apparatus of claim 1, wherein the sensor device (22) further comprises compensation means to suppress disturbance signals.

21. The use of a yarn supply apparatus, claim 22, for a flatbed knitting machine.

22. The yarn supply apparatus of claim 1, wherein said yarn store is a straight path substantially parallel to a translational direction of said yarn guide means.

23. The yarn supply apparatus of claim 1, wherein said yarn store extends from said yarn wheel to the knitting station.

24. The yarn supply apparatus of claim 1, wherein said means for defining a yarn travel path is substantially non-resilient.

25. A yarn supply apparatus for supplying yarn from a yarn source to a knitting station of a knitting machine, the yarn supply apparatus comprising:

a yarn wheel for storing and supplying yarn;

a yarn guide, said yarn wheel and yarn guide defining a yarn travel path over which the yarn travels to the knitting station;

a motor coupled to said yarn wheel for operatively rotating said yarn wheel;

a yarn tension sensor for detecting a tension of the yarn in the yarn travel path and providing a tension sensor signal in response thereto;

a closed-loop control device coupled to and controlling said motor in response to the tension sensor signal; and a yarn store for (i) temporarily storing yarn that has been supplied by said yarn wheel and not used by the knitting machine, and (ii) providing the yarn that is needed by the knitting machine upon abrupt fluctuation in the yarn tension but which has not been supplied by the yarn wheel; and wherein the yarn store is long enough that the yarn segment located in the store defines a spring constant which is below a predetermined limit value that is the quotient of the maximum change in force and the maximum yarn length that can be received by the yarn store.

26. The yarn supply apparatus of claim 25 wherein said yarn store includes a travel segment extending between the yarn wheel and the knitting station wherein the yarn is guided such that it can expand freely.

27. The yarn supply apparatus of claim 25 wherein said yarn store re-receives the yarn supplied by said yarn wheel but not used by the knitting machine.

28. The yarn supply apparatus of claim 25, wherein said yarn store is a straight path substantially parallel to a translational direction of said yarn guide means.

29. The yarn supply apparatus of claim 25, wherein said yarn store is defined from said yarn wheel to the knitting station.

30. The yarn supply apparatus of claim 25, wherein said means for defining a yarn travel path is substantially non-resilient.

* * * * *